US009055811B2

(12) United States Patent
Reithler

(10) Patent No.: US 9,055,811 B2
(45) Date of Patent: Jun. 16, 2015

(54) OFFICE DEVICE HAVING MULTIPLE SPATIAL CONFIGURATIONS

(75) Inventor: Christophe Reithler, Walferdange (LU)

(73) Assignee: Steelcase S.A., Schiltigheim (FR)

( * ) Notice: Subject to any disclaimer, the term of this patent is extended or adjusted under 35 U.S.C. 154(b) by 0 days.

(21) Appl. No.: 13/818,581

(22) PCT Filed: Aug. 24, 2011

(86) PCT No.: PCT/FR2011/000472

§ 371 (c)(1), (2), (4) Date: Jul. 2, 2013

(87) PCT Pub. No.: WO2012/025674

PCT Pub. Date: Mar. 1, 2012

(65) Prior Publication Data

US 2013/0284075 A1 Oct. 31, 2013

(30) Foreign Application Priority Data

Aug. 24, 2010 (EP) ..... 10305912

(51) Int. Cl.

| | |
|---|---|
| ***A47B 57/00*** | (2006.01) |
| ***A47B 21/03*** | (2006.01) |
| ***A47B 17/03*** | (2006.01) |
| ***A47B 17/06*** | (2006.01) |
| ***A47B 46/00*** | (2006.01) |

(52) U.S. Cl.

CPC ..... *A47B 21/03* (2013.01); *A47B 17/03* (2013.01); *A47B 17/065* (2013.01); *A47B 46/00* (2013.01)

(58) Field of Classification Search

CPC ..... A47B 3/00; A47B 3/0803; A47B 11/00; A47B 17/065; A47B 5/02

USPC ..... 108/115, 91, 92, 94, 93, 95, 96; 312/194, 317.3, 314, 322

See application file for complete search history.

(56) References Cited

U.S. PATENT DOCUMENTS

| | | | | |
|---|---|---|---|---|
| 654,922 | A * | 7/1900 | Schipkowsky | 312/196 |
| 1,269,225 | A * | 6/1918 | Sciannamea | 312/197 |
| 2,293,496 | A * | 8/1942 | Egger | 108/93 |

(Continued)

FOREIGN PATENT DOCUMENTS

WO 2005065482 7/2005

OTHER PUBLICATIONS

International Search Report, PCT/FR2011/000472, Jan. 30, 2012, 3 pages.

(Continued)

*Primary Examiner* — Jose V Chen

(74) *Attorney, Agent, or Firm* — Price Heneveld LLP

(57) ABSTRACT

The invention relates to an office device having multiple spatial configurations, including a first work surface and a second work surface, each of the two surfaces having a longitudinal axis and a transverse axis. The first work surface is connected, near a first end thereof, to the second work surface by assembly means enabling rotation of the first surface between a stowed position, in which the longitudinal axes of the work surfaces are aligned, and deployed positions, in which the longitudinal axes of the work surfaces are not aligned. The device is characterized in that the assembly means enable the sliding of the first surface along the longitudinal axis of the second work surface, as well as a rotation by an angle of no less than 90° at any point in the sliding path.

16 Claims, 6 Drawing Sheets

(56) References Cited

U.S. PATENT DOCUMENTS

| | | | | | |
|---|---|---|---|---|---|
| 2,580,032 | A | * | 12/1951 | Lindelof | 108/93 |
| 2,854,309 | A | * | 9/1958 | Levine | 312/317.3 |
| 2,928,703 | A | * | 3/1960 | Paulsen | 108/94 |
| 2,988,413 | A | * | 6/1961 | Bergen | 108/94 |
| 4,258,963 | A | * | 3/1981 | Fusselman et al. | 312/194 |
| 4,709,641 | A | | 12/1987 | Lenger | |
| 5,632,540 | A | * | 5/1997 | Wilcox | 108/94 |
| 5,666,887 | A | * | 9/1997 | Grabowski et al. | 108/91 |
| 5,683,154 | A | * | 11/1997 | Chang | 108/94 |
| 5,743,603 | A | * | 4/1998 | Kelley et al. | 312/194 |
| 5,947,035 | A | | 9/1999 | Chang | |
| 5,971,504 | A | * | 10/1999 | Kelley et al. | 312/194 |
| 6,145,448 | A | * | 11/2000 | Marschand et al. | 108/102 |
| 6,161,487 | A | * | 12/2000 | Chang | 108/64 |
| 6,422,668 | B1 | * | 7/2002 | Kelley et al. | 312/195 |
| 6,997,114 | B2 | * | 2/2006 | Chang | 108/94 |
| 7,273,212 | B1 | | 9/2007 | Kolbaba | |
| 7,469,644 | B2 | * | 12/2008 | Tseng | 108/94 |

OTHER PUBLICATIONS

Written Opinion of International Search Report, PCT/FR2011/000472, Feb. 26, 2013, 6 pages.

* cited by examiner

OFFICE DEVICE HAVING MULTIPLE SPATIAL CONFIGURATIONS

BACKGROUND OF THE INVENTION

This invention concerns a device for an office capable of taking on multiple spatial configurations.

This office device consists of several elements including one work surface which is capable of fitting inside the other elements or being brought to a position of use by pivoting and/or sliding.

This type of office device can be used in companies as well as in hotels, or in seminar facilities, etc. It meets the criteria of modularity, flexibility and allows the implementation of business policies aimed at the continuous improvement of the tasks performed particularly due to the arrangement of the work spaces. This type of office device therefore has the purpose of easily and quickly adapting the work environment on the basis of the type of activity and/or the number of users.

Numerous modular office devices of this type exist, which can be classified schematically in three categories, namely:

- office devices having an additional work surface which is movable only by rotation in relation to a main work surface or in relation to a storage container;
- office devices having a single work surface which is movable only by translation in relation to a fixed support of the shelving type;
- office devices having an additional work surface which is movable by means of a combination of different movements.

The document U.S. Pat. No. 6,145,448 describes in particular a structure which belongs to this third category, and discloses a small intermediate tray placed between two tables of the same height. This intermediate tray is movable between a closed position where the tray is hidden under the two tables placed one against the other, and an open position where the tray is accessible between the two tables placed apart from one another. This tray is connected to one the tables by pivoting and sliding means.

The major drawback of this configuration lies in the fact that the access to the intermediate tray is necessarily preceded by the displacement of one of the tables, which is not always easy for reasons of weight. Furthermore, the intermediate tray has a very restricted surface and its positioning in relation to the tables is limited to a single option.

SUMMARY OF THE INVENTION

The invention seeks to remedy these drawbacks by proposing an office device equipped with an additional work surface which is relatively large, easily movable by translation or rotation, and capable in practice of occupying numerous positions allowing multiple spatial configurations to be obtained in combination with the other elements of the table.

The invention also has the purpose of proposing a storage position of the additional work surface allowing the unit to be made very compact in the event of non-use of the additional work surface.

The office device having multiple spatial configurations per the invention includes a first work surface and a second work surface, these two surfaces each having a longitudinal axis and a transverse axis, the first work surface being connected, in the vicinity of a first end, to the second work surface by assembly means enabling a rotation of the first surface between a stowed position in which the longitudinal axes of the work surfaces are aligned, and deployed positions in which the longitudinal axes of the work surfaces are not aligned.

The office device has symmetry with regard to a longitudinal vertical medial plane, in stowed position.

In order to attain the above-cited objectives, the invention is characterized in that the assembly means enable a sliding of the first surface along the longitudinal axis of the second work surface, as well as a rotation by an angle of at least 90° at any point in the sliding path.

The first movable work surface can therefore make complex movements in relation to the second work surface which is fixed, and thus offers an additional work surface added to that of a traditional work surface.

One of the ideas at the basis of the invention is to propose an additional work surface which can take on multiple positions not only in a horizontal plane, but also in a vertical plane. To do this, the first work surface is equipped with height adjustment means. This possibility of vertical adjustment allows the user to adapt the office device to his size, and therefore to personalize his work space. These height adjustment means will be developed further in the description.

Advantageously, a tray is mounted under the second work surface so as to create a space between the second work surface and the tray for the passage of cables. The cables can also run under the entire length of the second work surface, remaining hidden while allowing the connection of computerized devices at any location.

Generally, the second work surface rests on two legs formed by lateral panels defining an arch with at least the second work surface, and the first work surface is connected in the area of its first end to the second work surface by assembly means and rests on the floor by means of a fixed base in the area of its second end, the assembly means consisting of a vertical shaft free to slide in a sliding rail of the office, with the longitudinal axis of the rail being aligned and fixed in relation to the longitudinal axis of the second work surface.

The base of the first work surface is provided with a fixed portion resting on the floor and with a movable portion featuring vertical sliding means in relation to the fixed portion.

More precisely, the adjustment of the height is made at the two ends of the first work surface. Thus, the height adjustment means of the first work surface are composed of:

- the telescopic vertical shaft;
- the vertical sliding means of the movable portion of the base; the shaft and the movable portion having a correspondence in the range of their vertical movement, with the first work surface always remaining horizontal.

According to a first configuration, the first work surface is mounted above the second work surface.

More precisely, the vertical shaft is mounted in pivoting fashion in a sliding rail provided in the second work surface, in which it can slide.

This sliding rail of the second work surface features stops at its ends. An upper protection, formed for example of flexible rubber pieces or simply a brush, closes off the rail so as to allow the sliding of the shaft while preventing objects present on the office (of the pen type) from falling inside of the rail.

Optionally, a parallelepipedal storage container is fixed under the tray. This container does not rest on the floor, thus allowing easy cleaning under the office.

According to a second configuration, the first work surface is mounted under the second work surface.

In stowed position, the first work surface is situated under the arch, with its base being accommodated in the area of one of the legs of the second work surface. In this case, the first work surface is stowed and no element exceeds the volume defined by the arch, so as to obtain a compact office allowing its users free access along its entire periphery.

In this configuration, the vertical shaft is mounted in pivoting fashion in a sliding rail made in the tray, in which it can slide. Contrary to the preceding configuration, the second work surface is uniform since it does not have a rail.

A protection will also close off the sliding rail of the tray in order to prevent cables or connectors from passing through the rail.

As in the first configuration, the ends of the sliding rail of the tray form stops for the shaft.

The location of the stops in the sliding rail is calculated in particular on the basis of the length of the first movable surface and the clearances desired between the first movable surface and the legs of the arch.

When the shaft arrives at a stopped position, it must be possible to pivot the first work surface in order to stow it under the second work surface, or to deploy it. This pivoting must be able to be made without the first work surface striking a leg regardless of the length of the second work surface.

For reasons of comfort of use or in order to allow the use of the office device in various work configurations, the first work surface in practice is provided with a maximum length compatible with its storage under the second work surface.

In order for the extraction/storage to remain possible regardless of the length of the first work surface, the profile of its first end is rounded in the form of a semi-circle with center corresponding to the center of rotation of the vertical shaft. Thus, when the shaft is in a stopped position, it is possible to pivot the tray while keeping a constant minimum clearance between its rounded edge and the adjacent leg.

Consequently, the location of the stops in the sliding rail is defined such that the edge of the first work surface is adjacent to the near leg of the arch, without contact from the stowed position to a position of deployed perpendicularity, when the shaft is in a stopped position.

According to one possibility, the second end of the first movable surface is not rounded but rectilinear with two right angles.

When the shaft is in a stopped position and the office device is stowed, the deployment of the first work surface must obviously be made without one of the right angles of its second end striking the near leg of the arch.

Thus, the maximum length of the first work surface is determined such that, in the stowed position with the shaft in a stopped position, the second end of the first work surface does not come into contact with the near leg during its deployment by rotation around the shaft.

According to a third possible configuration, the first work surface is mounted indirectly to the second work surface via a parallelepipedal storage container which is part of the office device.

The vertical shaft is then mounted in pivoting fashion in a sliding rail provided in the upper surface of a parallelepipedal storage container placed under all of the work surfaces and resting on the floor, with one end of the container being fastened to a first leg of the arch, and the other end of the container being distant from the second leg creating a space to accommodate the base of the first work surface in stowed position.

In the case where the first work surface is mounted above the second work surface, this latter element features an opening having the form of said rail of the container and cooperating with the vertical shaft. In fact, the vertical shaft supporting the first work surface is inserted in this opening and must be able to pivot and slide freely across the second work surface.

In the case where the first work surface is mounted under the second work surface, this latter element does not feature an opening and constitutes a large work counter. Just as for the second configuration, the location of the stops in the sliding rail is calculated on the basis of the length of the first work surface and the clearances desired between the first work surface and the legs of the arch so that the storage and deployment of the first work surface is made without contact with the arch.

Other advantages and characteristics of the invention will be made more apparent in the detailed description which follows and refers to the attached drawings given solely by way of example.

DETAILED DESCRIPTION

Figure 1A:
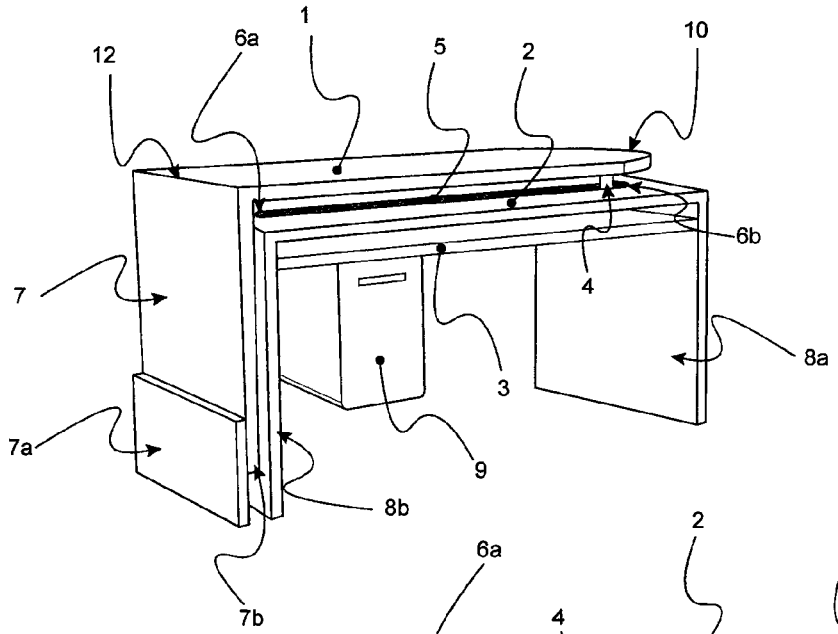
FIG. 1*a* is a schematic view illustrating the office device of the invention according to a first possible configuration.
Figure 1B:
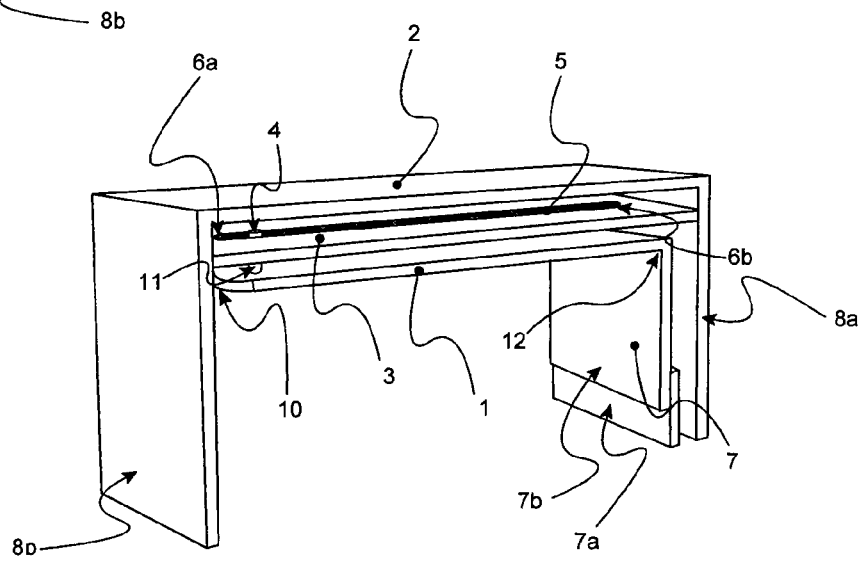
FIG. 1*b* represents the office device according to a second possible configuration.
Figure 1C:
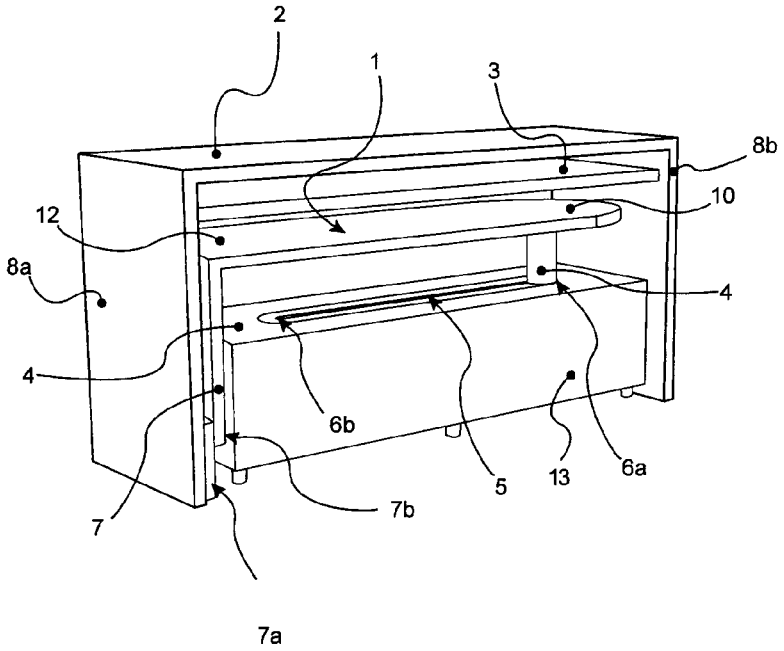
FIG. 1*c* shows a third possible configuration of the office device.

In FIGS. 1*a* to 1*c*, the office device is represented in its most compact form due to the alignment one under the other of the various elements composing this office device.

The elements in this case correspond to:

a first movable work surface (1); and a second fixed work surface (2).

The first work surface (1) is positioned above the second work surface (2) in FIG. 1*a*, and underneath the second work surface (2) in FIGS. 1*b* and 1*c*.

Generally, the height of the upper work surface is approximately 1000 mm, which corresponds to a raised work height which users can take advantage of when they are standing or by means of chairs which are also raised, such as bar chairs for example.

The height of the lower work surface is approximately 730 mm corresponding to a standard work height associated with office chairs.

More precisely, the second work surface (2) rests on two legs (8*a*, 8*b*) composed of lateral panels having the same width as the second work surface (2). This latter element is thus fixed in relation to the floor. A tray (3) is mounted under this second work surface (2) in the manner of shelving. The space defined between this tray (3) and the work surface (2) allows the storing away/routing of computer cables and of current.

The second work surface (2), its two legs (8*a*, 8*b*) and its tray (3) form a fixed arch.

As represented in FIG. 1*a*, the first work surface (1) is:

supported by a base (7) at a first end (12), said base (7) being formed by a lateral panel achieving a good stability for the work surface (1); and mounted above the arch in the area of its second end (10) by means of a vertical shaft (4).

The first work surface (1) is rotatable in relation to the axis marked by the vertical shaft (4), with this element being capable of sliding in the sliding rail (5) made in the second work surface (2) at the longitudinal medial plane. Consequently, the first work surface (1) is also movable in translation along the longitudinal axis of the sliding rail (5).

Figure 2:
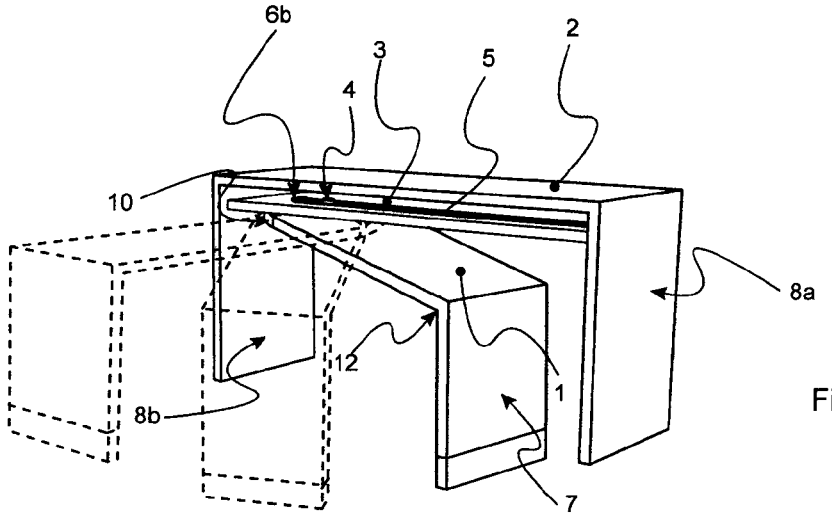
FIGS. 2 to 12 represent examples of spatial arrangements of an office device according to the second configuration, adapted to different work environments.

The first work surface (1) can pivot and slide simultaneously so as to take numerous positions relative to the arch, as will be illustrated based on FIG. 2.

The base (7) is provided with a fixed portion (7*a*) resting on the floor and a movable portion (7*b*) capable of sliding vertically in relation to the fixed portion (7*a*). The movable portion (7*b*) of the base cooperates with the shaft (4) which is telescopic. The height of the first work surface (1) can then be adjusted based on the deployment of the telescopic shaft (4), with the movable portion (7*b*) of the base (7) following the movement of the shaft (4) so as to guarantee the horizontality of the work surface (1).

A storage container (9) is fixed under the tray (3) of the arch, for example. This container is suspended from the arch, without contact with the floor.

FIG. 1*b* differs from FIG. 1*a* in that the first work surface (1) is mounted this time under the arch in the area of its second end (10) by means of the vertical shaft (4). This latter element is mounted in pivoting fashion in the sliding rail (5) made in the tray (3) in which it can slide. The ends (6*a*, 6*b*) of the sliding rail (5) form stops for the shaft (4).

In stowed position, the shaft (4) is stopped, and the base (7) of the first work surface (1) is housed in the vicinity of one of the legs (8*a*, 8*b*) of the second work surface (2).

The profile of the first end (10) of the first work surface (1) is rounded in the form of a semi-circle with center (11) corresponding to the center of rotation of the vertical shaft (4).

The location of the stops (6*a*, 6*b*) in the sliding rail (5) is defined such that the edge of the first work surface (1) is adjacent to the near leg (8*a*, 8*b*), without contact, when the shaft (4) is in stopped position.

The length of the first work surface (1) is determined such that, in stowed position with the shaft (4) stopped, the second end (12) of the first work surface (1) does not come into contact with the near leg (8*a*, 8*b*) during its deployment.

FIG. 1*c* illustrates a configuration of the office device with a parallelepipedal storage container placed on the floor, under the work surfaces (1, 2). One end of the container (13) is fixed to a leg (8*b*) of the arch, while the other end is distant from the other leg (8*a*) of the arch. This container (13)/leg (8*a*) distance creates a free storage space for the base (7) of the first work surface (1).

The first work surface (1) is rotatable in relation to the axis marked by the vertical shaft (4) located in the transverse medial plane of the container (13). This vertical axis (4) slides in a sliding rail (5) worked in the upper surface (14) of the container (13) in the longitudinal direction. Consequently, the first work surface (1) is also displaceable along the longitudinal axis of the rail (5).

Whether the first work surface (1) is stowed or deployed, the access to the storage container (13) as well as access to the second work surface (2) remains easy.

Figure 3:
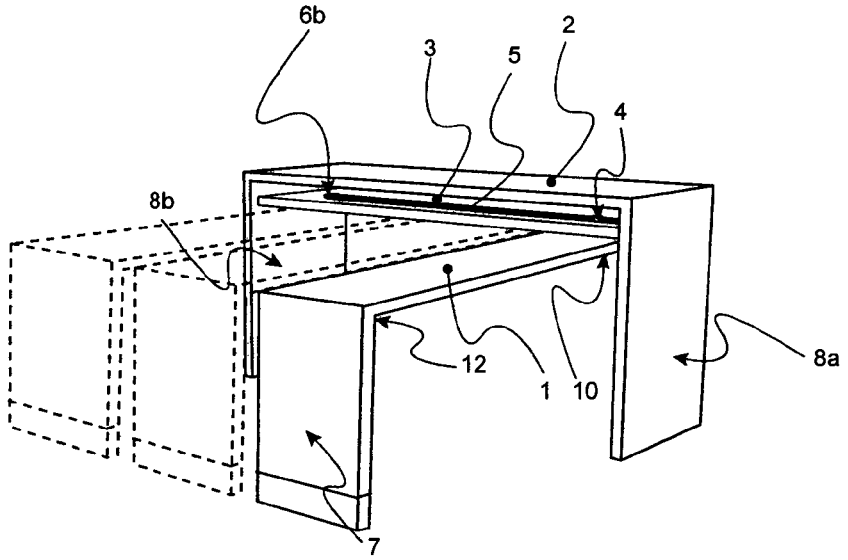
Figure 4:
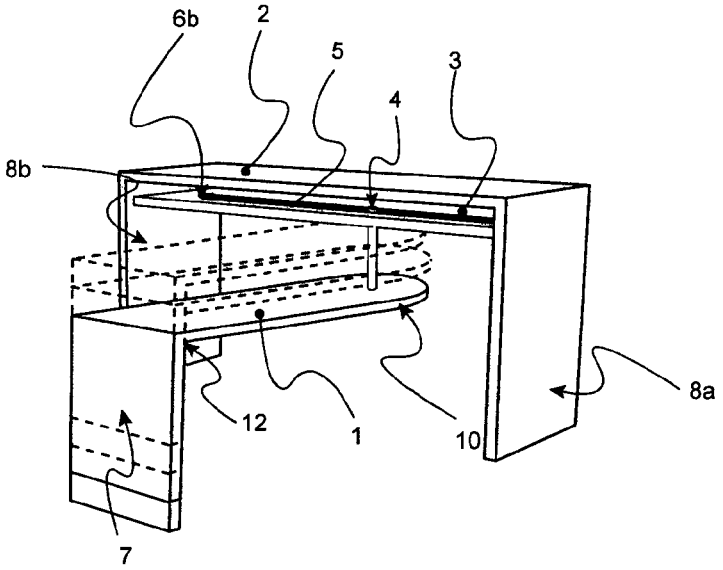

FIGS. 2 to 4 represent the various possibilities of deployment and adjustment of the first work surface (1) which is movable relative to the fixed arch. Its pivoting movement is illustrated in FIG. 2, its translation movement in FIG. 3, and various height positions in FIG. 4.

FIGS. 5 to 12 depict possible configurations of work zones by means of several office devices adapting quickly and easily to various activities by means of intuitive and fluid displacements of the movable first work surface (1).

Figure 5:
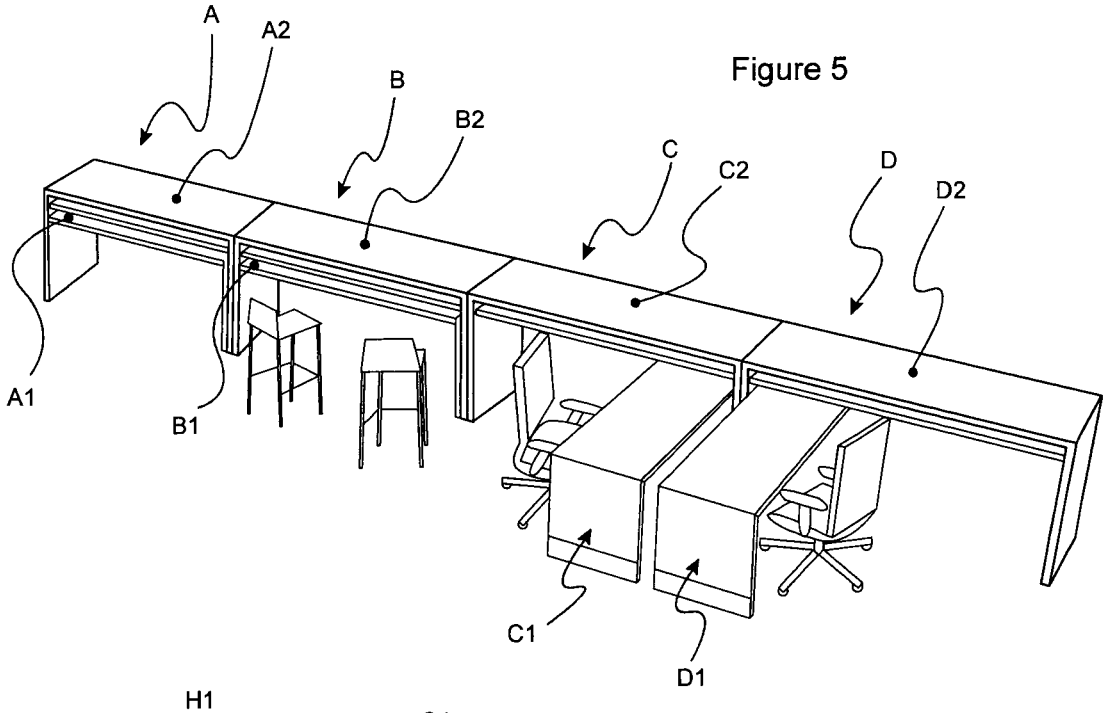

FIG. 5 represents a work area favoring contact among persons. In this configuration, four aligned office devices (A, B, C, D) define a work area where people can discuss and work, either side by side on a same arch (A2, B2) with the movable surface (A1, B1) stowed, or face to face on two movable work surfaces (C1, D1) positioned practically one against the other perpendicular to the arch (C2, D2).

Figure 6:
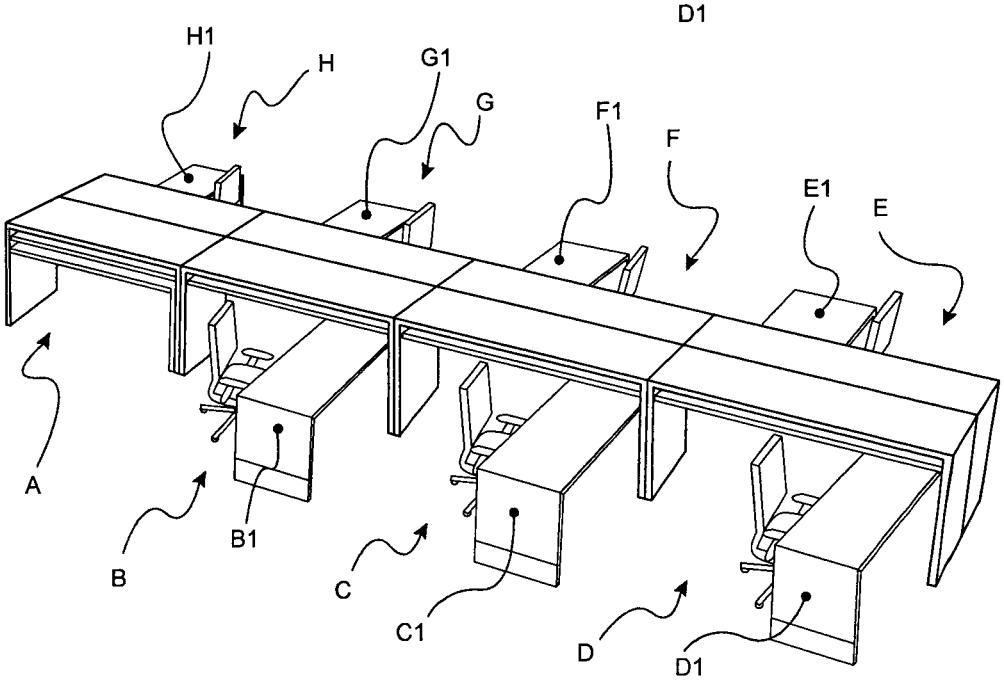

FIG. 6 presents a configuration highlighting the adaptability of the work environment based on the number of collaborators in a work team. For more flexibility, the office devices (A, B, C, D, E, F, G, H) are placed in the same direction, and aligned in two rows, forming a large central work space. Movable work surfaces (B1, C1, D1, E1, F1, G1, H1) may thus be deployed on both sides in this central work space. Preferably, each collaborator may deploy a movable surface (B1, C1, D1, E1, F1, G1, H1) in order to create his own work space, while remaining close to the other collaborators.

Figure 7:
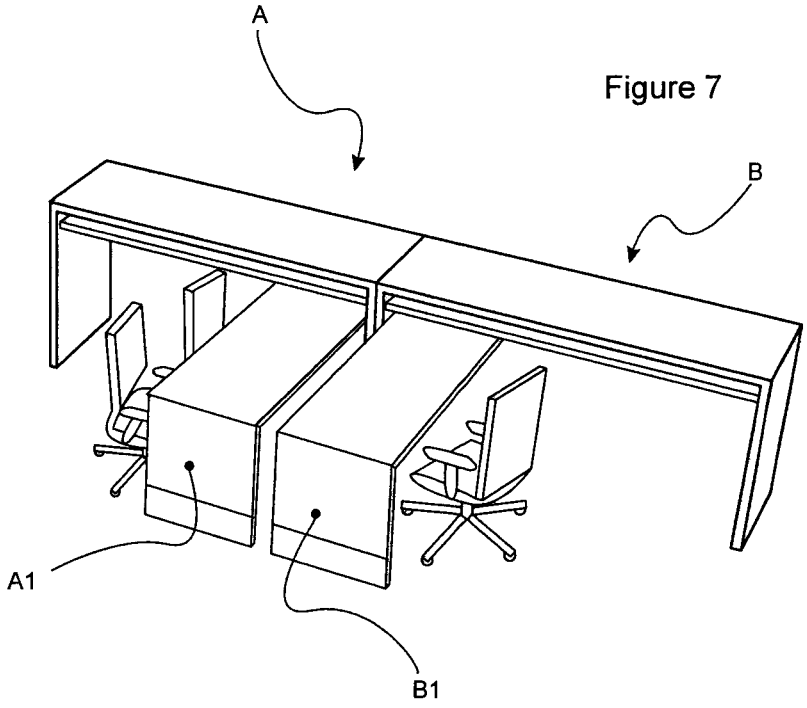
Figure 8:
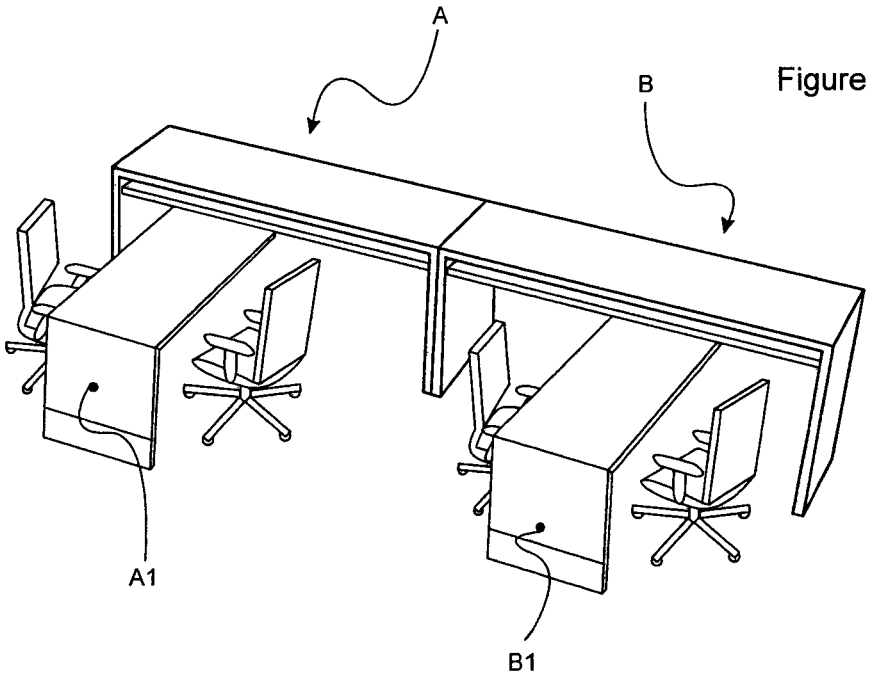

The configurations represented in FIGS. 7 and 8 seek to create a work space intended for a single person and allowing one or two additional persons to join him on occasion. The office devices (A, B) are positioned similarly to FIG. 5 with the movable work surfaces (A1, B1) moved together. This configuration lends itself to the office of a manager or a department head wishing to host one or several collaborators at his office for a small committee meeting.

The movable surface (A1) offers the advantage of a sufficiently large work surface, along its length, for two persons placed side by side on the same side, or two persons placed facing each other in staggered fashion.

Figure 9:
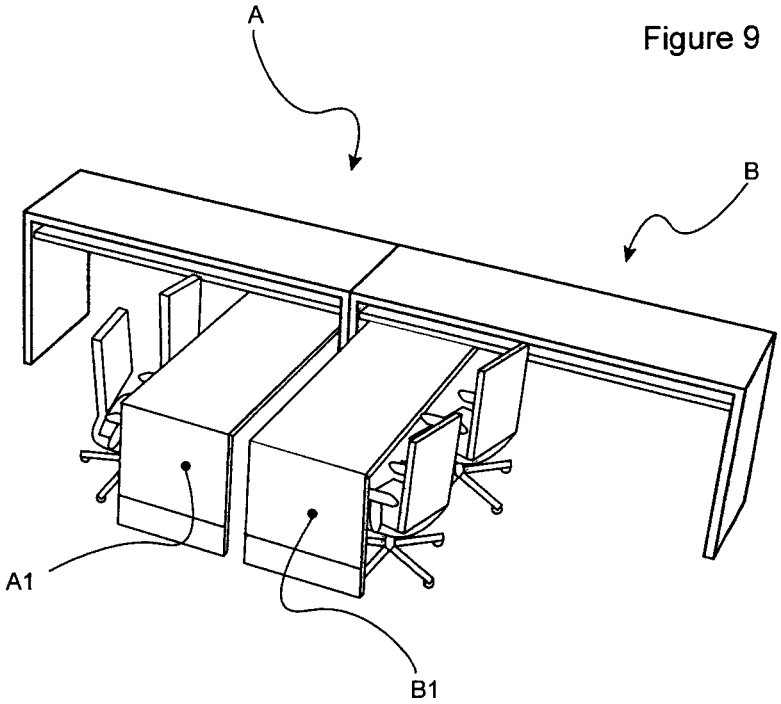

With a configuration identical to that of FIG. 7, FIG. 9 illustrates the case of a work space corresponding to a conference room.

Figure 10:
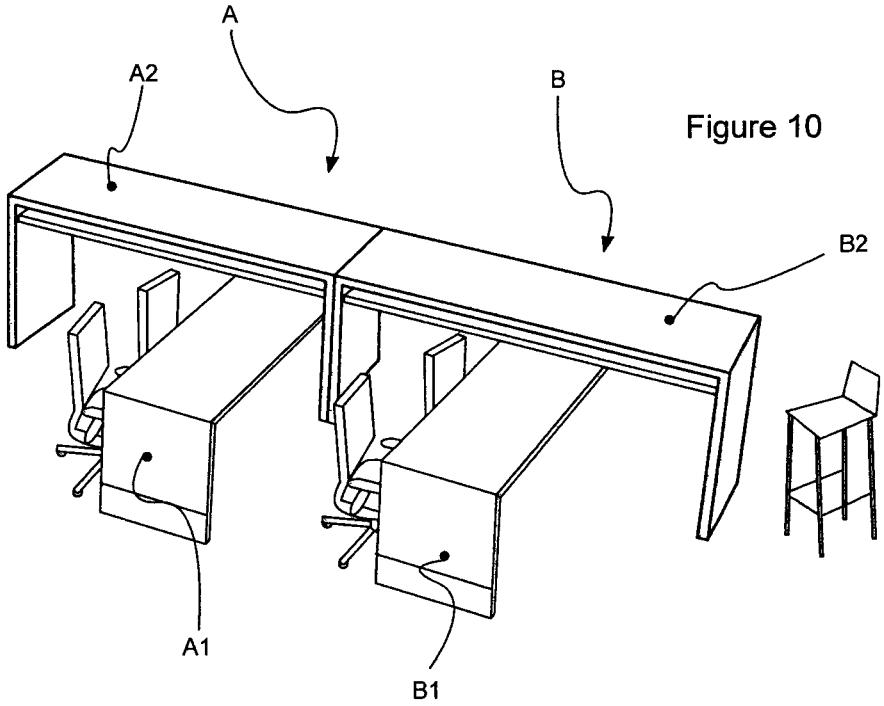

FIG. 10 represents a space adapted to training sessions, where the trainer positions himself at the end of the arch (B2), facing the participants seated in rows of two with regard to the movable surfaces (A1, B1).

Figure 11:
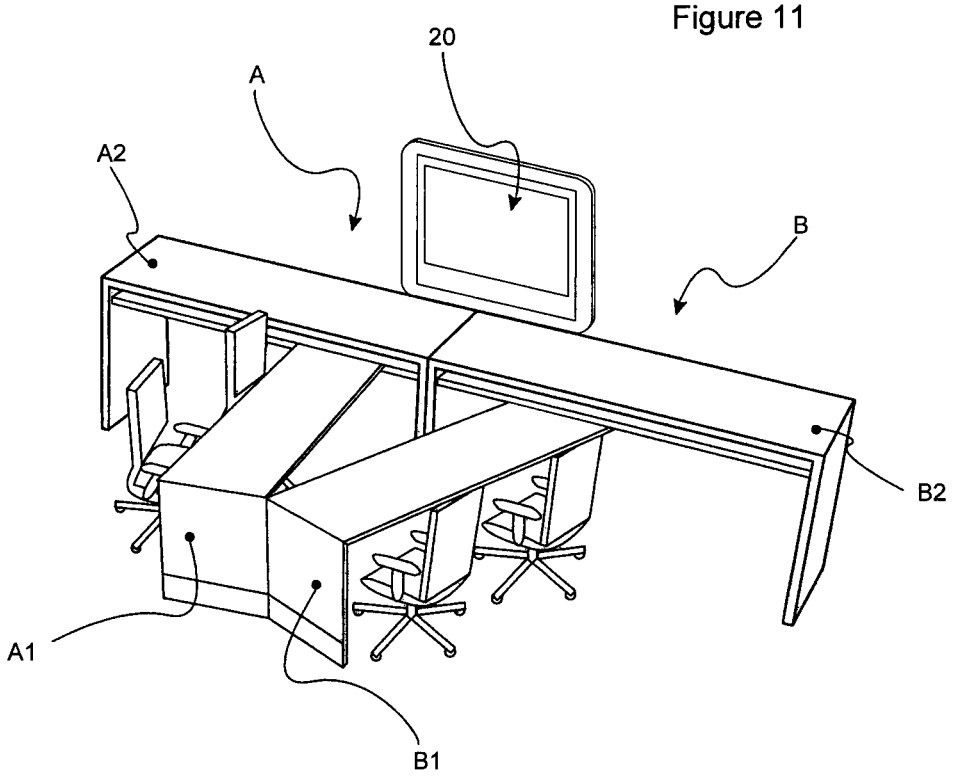
Figure 12:
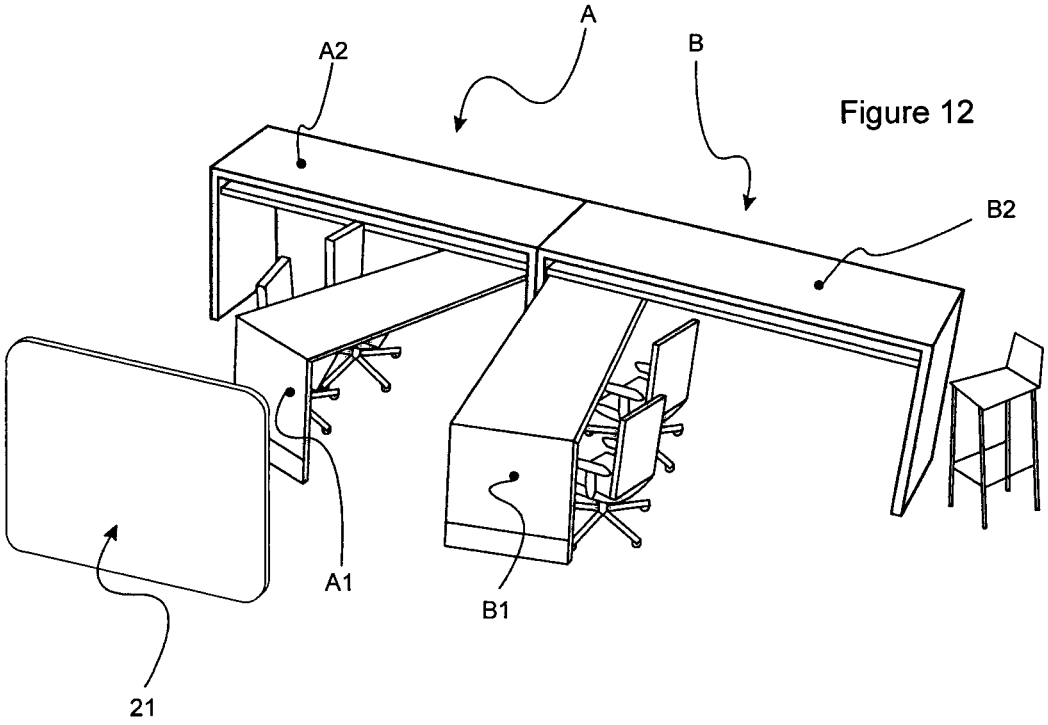

FIGS. 11 and 12 present a configuration provided for meetings or teleconferences. The movable surfaces (A1, B1) are no longer placed perpendicularly to the arches (A2, B2), but obliquely so as to allow all of the meeting participants to have a proper view of either a television (20), or a presentation board (21).

Of course, the invention is not limited to the configuration examples described and illustrated.

The invention claimed is:

1. An office device having multiple spatial configurations, the office device comprising:

a first work surface having a first end and a second end;

a second work surface having a longitudinal axis;

wherein the first and second work surfaces each have a longitudinal axis and a transverse axis, the first work surface being connected, near its first end, to the second work surface by an assembly enabling rotation of the first work surface between a stowed position in which the longitudinal axes of the first and second work surfaces are aligned, and at least one deployed position in which the longitudinal axes of the first and second work surfaces are not aligned, the assembly enabling a sliding of the first work surface along the longitudinal axis of the second work surface, as well as a rotation by an angle of at least 90° at any point in the sliding path, and wherein the second work surface rests on two legs formed by lateral panels defining an arch with at least the second work surface, and wherein the first work surface is supported on the floor by a support base attached to the first work surface in the area of its second end, the assembly including a vertical shaft that is free to slide in a sliding rail of the desk, the sliding rail having a longitudinal axis aligned and fixed in relation to the longitudinal axis of the second work surface; and wherein:

the first work surface includes a height adjustment feature.

2. The office device of claim 1, including:

a tray mounted under the second work surface to create a space between the second work surface and the tray for the passage of cables.

3. The office device of claim 2, wherein:

the base of the first work surface includes a fixed portion resting on the floor and a movable part that slides vertically relative to the fixed portion.

4. The office device of claim 3, wherein:

the means for height adjustment of the first work surface comprises a telescopic vertical shaft and vertical sliding means of the movable portion of the base, the shaft and the movable portion having a correspondence in the range of their vertical movement, with the first work surface always remaining horizontal.

5. The office device of claim 4, wherein:

the first work surface is mounted above the second work surface.

6. The office device of claim 5, wherein:

the second work surface includes a sliding rail, and the vertical shaft is mounted in a pivoting and sliding fashion in the sliding rail of the second work surface.

7. The office device of claim 6, wherein:

the sliding rail of the second work surface features stops at its ends.

8. The office device of claim 5 including:

a parallelepipedal storage container fixed under the tray.

9. The office device of claim 5, including:

a parallelepipedal storage container a sliding rail in an upper surface of the storage container, and wherein:

the vertical shaft is pivotably mounted in the sliding rail of the storage container, and wherein the storage container is positioned under the first and second work surfaces and resting on a floor, the storage container defining ends, wherein one end of the storage container is fixed to a first leg of the arch, wherein the other end of the storage container is distant from the second leg, creating a space to accommodate the base of the first work surface in a stowed position.

10. The office device of claim 4, wherein:

the first work surface is mounted under the second work surface.

11. The office device of claim 10, wherein:

in the stowed position the first work surface is situated under the arch, its base being accommodated in the vicinity of one of the legs of the second work surface.

12. The office device of claim 11, wherein:

the tray includes a sliding rail, and the vertical shaft is slidably and pivotably mounted in the sliding rail.

13. The office device of claim 12, wherein:

the sliding rail of the tray includes ends that form stops for the shaft.

14. The office device of claim 13, wherein:

a profile of the first end of the first work surface is rounded in semi-circle form with a center corresponding to a center of rotation of the vertical shaft.

15. The office device of claim 14, wherein:

the location of the stops in the sliding rail is defined such that an edge of the first work surface is adjacent to the near leg of the arch, without contact of the stowed position to a position of deployed perpendicularity, when the shaft is stopped.

16. The office device of claim 15, wherein:

the length of the first work surface is determined such that, in a stowed position with the shaft in a stopped position, the second end of the first work surface does not come in contact with the near leg during its deployment by rotation around the shaft.

* * * * *